US009308564B2

(12) United States Patent
Potocki et al.

(10) Patent No.: US 9,308,564 B2
(45) Date of Patent: Apr. 12, 2016

(54) HOT STAMPING SYSTEM AND METHOD

(71) Applicants: John Richard Potocki, Armada, MI (US); Tad Stewart Wiseman, Clarkston, MI (US)

(72) Inventors: John Richard Potocki, Armada, MI (US); Tad Stewart Wiseman, Clarkston, MI (US)

(73) Assignee: Magna International Inc., Aurora, Ontario (CA)

( * ) Notice: Subject to any disclaimer, the term of this patent is extended or adjusted under 35 U.S.C. 154(b) by 347 days.

(21) Appl. No.: 14/069,441

(22) Filed: Nov. 1, 2013

(65) Prior Publication Data

US 2014/0144198 A1 May 29, 2014

Related U.S. Application Data

(60) Provisional application No. 61/730,667, filed on Nov. 28, 2012.

(51) Int. Cl.

| | |
|---|---|
| ***B21D 22/00*** | (2006.01) |
| ***B21D 22/02*** | (2006.01) |
| ***B21D 35/00*** | (2006.01) |
| ***B21D 53/88*** | (2006.01) |
| ***B21D 37/16*** | (2006.01) |
| ***B21D 43/08*** | (2006.01) |
| ***C21D 9/00*** | (2006.01) |
| ***F27B 9/02*** | (2006.01) |
| ***F27B 9/24*** | (2006.01) |
| *C21D 1/673* | (2006.01) |

(52) U.S. Cl.

CPC ..... *B21D 22/022* (2013.01); *B21D 35/00* (2013.01); *B21D 37/16* (2013.01); *B21D 43/08* (2013.01); *B21D 53/88* (2013.01); *C21D 9/005* (2013.01); *F27B 9/024* (2013.01); *F27B 9/2407* (2013.01); *C21D 1/673* (2013.01)

(58) Field of Classification Search

CPC ..... B21D 22/00; B21D 35/00; B21D 37/16; B21D 53/88; C21D 9/005

USPC ..... 72/342.1

See application file for complete search history.

(56) References Cited

U.S. PATENT DOCUMENTS

| | | | | |
|---|---|---|---|---|
| 7,137,201 | B2 * | 11/2006 | Brodt | B21D 37/16 29/505 |
| 9,032,605 | B2 * | 5/2015 | Keys | B21D 53/88 29/429 |
| 2009/0155615 | A1 * | 6/2009 | Chen | B21D 35/00 428/593 |
| 2011/0283851 | A1 * | 11/2011 | Overrath | B21D 22/00 83/15 |
| 2014/0144198 | A1 * | 5/2014 | Potocki | C21D 9/005 72/342.1 |

* cited by examiner

*Primary Examiner* — David B Jones

(74) *Attorney, Agent, or Firm* — Dickinson Wright PLLC

(57) ABSTRACT

A system for forming a plurality of hot stamped steel parts for automotive applications includes a furnace with a stack of sealed chambers, each containing an individual heater, for simultaneously heating a plurality of blanks. Each chamber is removable from the furnace, so that if the heater contained therein malfunctions, the heater can be repaired while the other chambers continue to heat the blanks. Each chamber also comprises a shelf including a plurality of driven rollers for conveying the blanks through the furnace. A blank feeder also including a plurality of driven rollers extends continuously from the furnace to a hot forming apparatus. The hot forming apparatus includes a plurality of cavities for shaping one or more of the blanks into a plurality of the parts.

20 Claims, 2 Drawing Sheets

HOT STAMPING SYSTEM AND METHOD

CROSS REFERENCE TO RELATED APPLICATION

This U.S. patent application claims the benefit of U.S. Provisional Patent Application Ser. No. 61/730,667 filed Nov. 28, 2012, entitled "Hot Stamping System And Method," the entire disclosure of the application being considered part of the disclosure of this application and hereby incorporated by reference.

BACKGROUND OF THE INVENTION

1. Field of the Invention

The inventions relates generally to a system and method for hot forming a plurality of parts, such as steel parts for chassis and automotive body applications.

2. Related Art

Hot forming processes typically comprise heating a steel blank in a furnace, followed by stamping the heated blank between a pair of dies to form a shaped part, and quenching the shaped part between the dies. The steel blank is typically heated in the furnace to achieve an austenitic microstructure, and then quenched in the dies to transform the austenitic microstructure to a martensitic microstructure. The hot forming process preferably runs continuously to produce a plurality of the shaped parts at a high rate and low cost. However, when the furnace malfunctions, the entire system must be shut down for a period of time while the furnace is repaired, which increases the cost per part produced by the system.

SUMMARY OF THE INVENTION

The invention provides a system for hot forming a plurality of parts, such as steel parts for use as chassis or body components of an automobile. The system comprises a furnace including a plurality of shelves stacked vertically relative to one another. Each shelf includes a plurality of driven rollers for conveying a plurality of blanks through the furnace. The furnace also includes a plurality of heaters for heating the blanks, wherein each heater is disposed adjacent one of the shelves. Each shelf and the adjacent heater is removable from the furnace, for example when the heater is malfunctioning. The system further includes a hot forming apparatus for shaping the heated blanks, and a blank feeder for conveying the heated blanks from the shelves of the furnace to the hot forming apparatus.

The invention also provides a method for hot forming a plurality of parts. The method includes conveying a plurality of blanks along a plurality of shelves of a furnace, and heating the plurality of blanks using a heater disposed adjacent each shelf. The method also includes removing the heater and the adjacent shelf from the furnace when the heater is malfunctioning while continuing to heat the blanks on the other shelves. The method further includes conveying the heated blanks from the furnace to a hot forming apparatus, and shaping the heated blanks in the hot forming apparatus.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
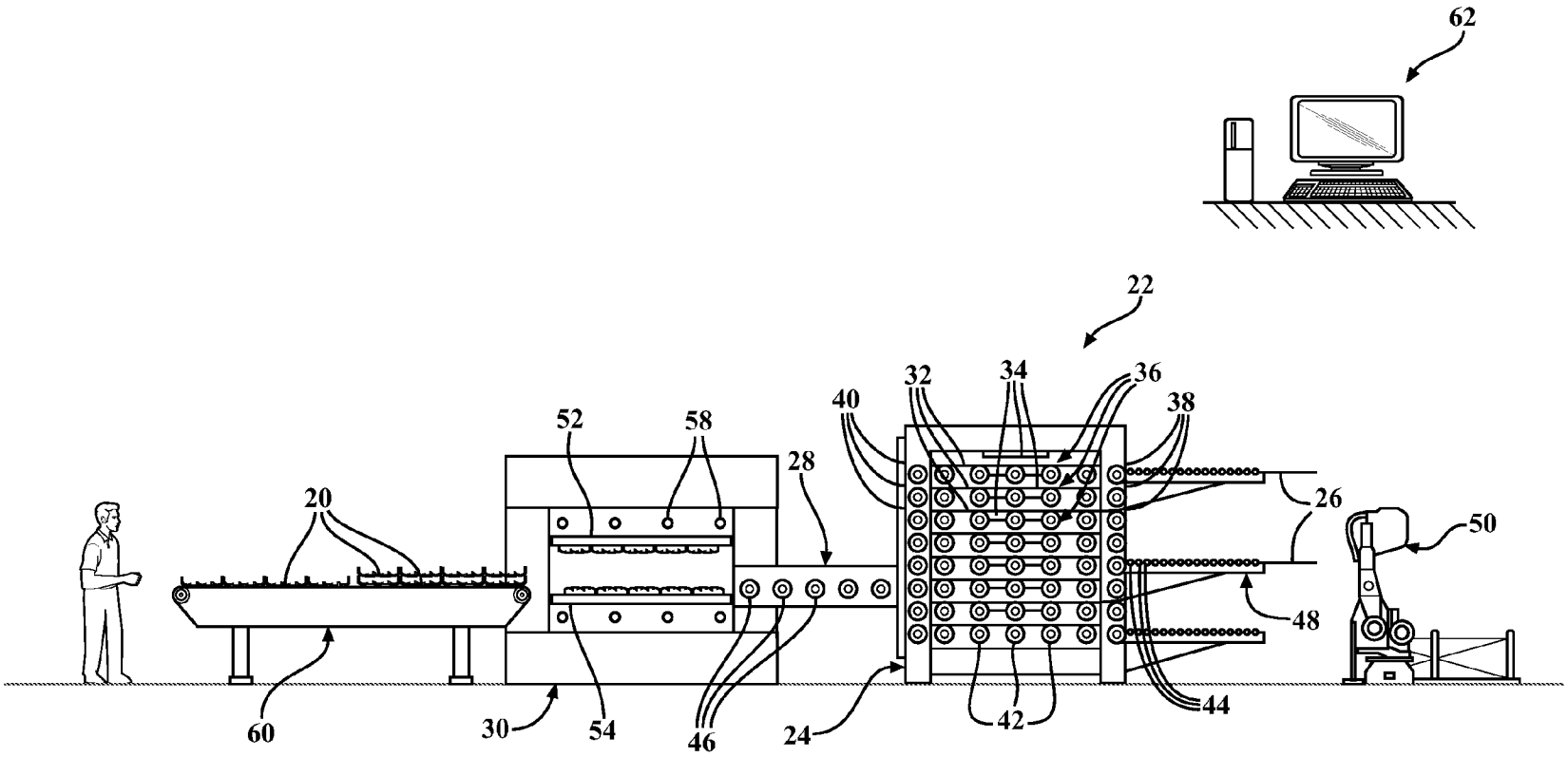
FIG. 1 is a side view of an exemplary hot forming system for producing a plurality of shaped parts.

Referring to the Figures, wherein like numerals indicate corresponding parts 20 throughout the several views, an exemplary system 22 for hot forming a plurality of shaped parts 20 is generally shown in FIG. 1. The system 22 includes a furnace 24 for heating a plurality of blanks 26, a hot forming apparatus 30 for shaping the heated blanks 26, and a blank feeder 28 for conveying the heated blanks 26 from the furnace 24 to the hot forming apparatus 30. The system 22 provides reduced down time and thus reduced overhead costs per part 20, compared to other hot forming systems. The system 22 also requires less floor space compared to the other systems.

The blanks 26 used to manufacture the shaped parts 20 are typically formed of metal, but can be formed of other materials. In one exemplary embodiment, the blanks 26 are formed of steel material, such pure steel or a steel alloy. Although the shaped parts 20 are typically designed for use as chassis or automotive body components, the parts 20 can alternatively be used in other applications.

The system 22 includes the furnace 24 for heating a plurality of the blanks 26 prior to shaping the blanks 26 in the hot forming apparatus 30. The furnace 24 includes a plurality of shelves 32 stacked vertically relative to one another and a heater 34 disposed adjacent each shelf 32. Each heater 34 can comprise a single heating element or a plurality of heating elements. For example, each heater 34 could include a plurality of tubes containing burning gas, or a plurality of heated coils. Each shelf 32 extends horizontally from a first side to a second side opposite the first side and presents an area capable of supporting at least one blank 26, but preferably a plurality of the blanks 26. In addition, each shelf 32 is fixable to other shelves 32, and each shelf 32 and the adjacent heater 34 is individually removable from the furnace 24.

Preferably, the furnace 24 includes a plurality of chambers 36 stacked vertically relative to one another and each including one of the shelves 32 and one of the heaters 34, as shown in FIG. 1. Each chamber 36 is individually fixable to other chambers 36 and individually removable from the stack of chambers 36. In the exemplary embodiment, a first door 38 is located at the first side of each chamber 36 and a second door 40 is located at the second side of each chamber 36 to seal the chambers 36 from the outside environment and from one another. The first doors 38 can open automatically to receive unheated blanks 26, and the second doors 40 can open automatically to release heated blanks 26 for subsequent shaping in the hot forming apparatus 30.

The shelves 32 of the furnace 24 include a plurality of first driven rollers 42 extending from the first side to the second side for conveying the blanks 26 through the furnace 24. The first driven rollers 42 can comprise mechanically driven ceramic rollers or rollers of the type used in hearth type furnaces. The first driven rollers 42 of the furnace 24 can rotate continuously, remain stationary for periods of time, or oscillate forward and backward, depending on the amount of heating desired. In addition, the first driven rollers 42 of one shelf 32 can move or rotate at a rate different from the first driven rollers 42 of another shelf 32. For example, the blanks 26 being conveyed along one of the lower shelves 32 can remain in the furnace 24 for a longer period of time than blanks 26 being conveyed along one of the upper shelves 32, to achieve different microstructures in those blanks 26.

As mentioned above, the furnace 24 includes the plurality of heaters 34 for heating the blanks 26 as they continuously move through the furnace 24 or rest in the furnace 24 for a period of time. Each heater 34 is disposed adjacent one of the shelves 32 for heating the blanks 26 disposed on that shelf 32. In the exemplary embodiment of FIG. 1, each sealed chamber 36 includes its own heater 34. The heater 34 can comprise a gas burner, an electric heater, or another type of heater. The heaters 34 preferably maintain all of the chambers 36 at approximately the same temperature, but could be configured to maintain one or more of the chambers 36 at a temperature different from other chambers 36. The temperature of the chambers 36 can be adjusted to achieve the desired microstructure in the blanks 26 moving through the chambers 36. For example, if the blanks 26 are formed of steel material, they are preferably heated to an austenitizing temperature prior to being formed. The furnace 24 typically includes a controller (not shown) to determine whether the blanks 26 have reached a predetermined temperature, either with sensors placed inside of the chambers 36 or by monitoring the amount of time that each blank 26 remains in of the furnace 24, and to adjust the amount of time that the blanks 26 are in the furnace 24.

The furnace 24 of the inventive system is advantageous compared to furnaces of other hot forming systems because it can continue running even if one or more of the heaters 34 malfunctions or fails. Thus, the hot forming system 22 can continuously form the shaped parts 20 with little or no down time. For example, the chamber 36 containing the malfunctioning heater 34 can be removed from the stack of chambers 36 and repaired while the blanks 26 continue moving through the remaining heated chambers 36. Alternatively, if the furnace 24 contains the stack of shelves 32, the malfunctioning heater 34 and the adjacent shelf 32 can be removed from the stack. The reduction in down time provided by the system 22 reduces the overhead costs per shaped part 20 produced. In addition, the furnace 24 with the stacked shelves 32 or chambers 36 requires less floor space than other comparatively sized furnaces.

The exemplary system 22 also includes a blank loader 48, preferably an indexing blank loader including a plurality of second driven rollers 44 for feeding the unheated blanks 26 to the shelves 32 of the furnace 24. The second driven rollers 44 of the blank loader 48 align with and are timed to move with the first driven rollers 42 of one of the shelves 32. Thus, the first and second driven rollers 42, 44 rotate at approximately the same rate and move one or more of the unheated blanks 26 through the first door 38 and through the chamber 36. The system 22 can also include a robot 50 with a controller for automatically disposing the unheated blanks 26 on the blank loader 48. Alternatively, the system 22 could be fed from a coil of material which is divided to form the plurality of blanks 26 at some point during the process.

In the exemplary system, the blank loader 48 is movable vertically along the first sides of the chambers 36 for feeding the blanks 26 onto each of the shelves 32 of the furnace 24. This blank loader 48 is configured to automatically raise or lower the blanks 26 and feed them into the open chambers 36. FIG. 1 shows the blank loader 48 in a lower position, a middle position, and an upper position. Alternatively, the blank loader 48 could be removable from the furnace 24 and mounted on another robot (not shown). The second robot could plug the blank loader 48 into the furnace 24 after the first robot 50 disposes the unheated blanks 26 on the blank loader 48. In yet another embodiment, the unheated blanks 26 could be loaded into the furnace 24 manually or by another type mechanical blank loading system.

Figure 2:
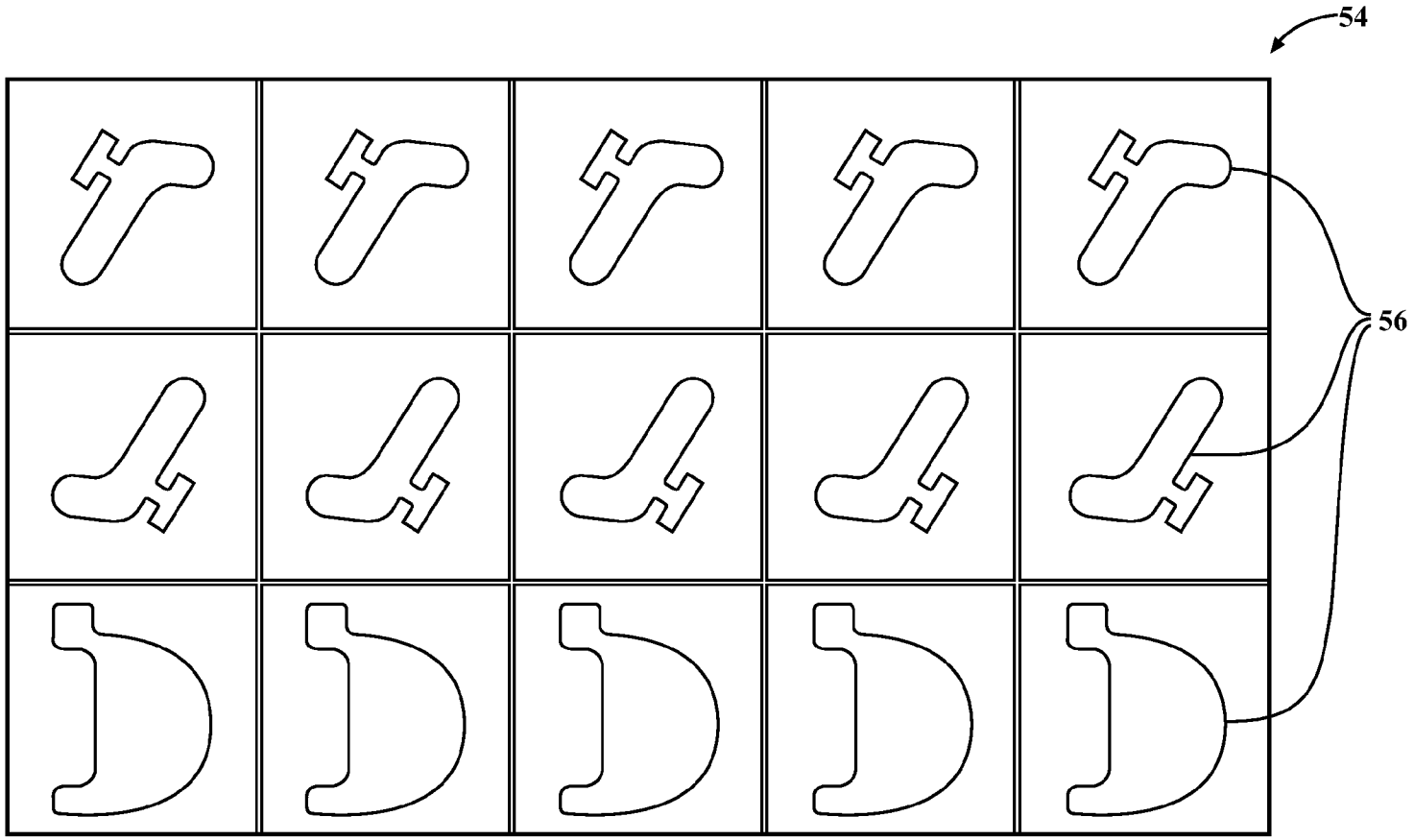
FIG. 2 is an exemplary die of a hot forming apparatus used in the system of FIG. 1.

The system 22 also includes the hot forming apparatus 30 for forming the heated blanks 26 into a plurality of the shaped parts 20. The hot forming apparatus 30 is preferably a hot stamping press including an upper die 52 and a lower die 54 facing one another and presenting at least one cavity 56 therebetween for shaping at least one of the heated blanks 26. In the exemplary embodiment, the dies present a plurality of cavities 56 for simultaneously shaping at least one of the heated blanks 26 into a plurality of the shaped parts 20, or a plurality of the heated blanks 26 into a plurality of the shaped parts 20. The cavities 56 could be similarly shaped or differently shaped for simultaneously producing different types of parts 20. In addition, the upper die 52 and the lower die 54 are interchangeable and removable from the hot forming apparatus 30. For example, the upper die 52 and lower die 54 can be exchanged for dies having different designs. FIG. 2 illustrates an exemplary die 52, 54 including a three by five array of cavities 56 for simultaneously producing five parts 20 of three different automotive components. However, any desirable number of cavities 56 could be included in the hot forming apparatus 30. The hot forming apparatus 30 with the plurality of cavities 56 provides a batch forming process which allows for manufacturing cost savings by reducing the amount of time required to produce each part 20.

The hot forming apparatus 30 also includes a plurality of cooling ports 58 extending along the cavities 56 for conveying a cooling fluid therethrough, such as water or any other cooling fluid. Thus, the shaped parts 20 can be quenched after the shaping process is complete, and while the shaped parts 20 are still in the cavities 56. The quantity and temperature of water fed through the cooling ports 58, as well as the shapes and locations of the cooling ports 58, can be chosen to achieve a desired quenching rate, and thus achieve the desired microstructure in the metal parts 20. For example, when the blanks 26 are formed of the steel material, the quenching step includes rapidly cooling the shaped parts 20 to transform the austenitic microstructure to a martensitic microstructure. In addition, one or more of the cooling factors could be varied for different cavities 56 to simultaneously produce a plurality of shaped parts 20 having different microstructures. The hot forming apparatus 30 typically includes a controller (not shown) to actuate the dies 52, 54 after one or more heated blanks 26 is properly placed between the dies 52, 54. The controller of the hot forming apparatus 30 can also adjust the amount of time that the parts 20 are quenched between the dies 52, 54.

The exemplary system 22 also includes the blank feeder 28 disposed opposite the blank loader 48 and extending continuously from the furnace 24 to the hot forming apparatus 30 for conveying the heated blanks 26 to the hot forming apparatus 30. The blank feeder 28 is preferably an indexing blank feeder and includes a plurality of third driven rollers 46. The indexing feature of the blank feeder 28 can comprise a plurality of indexing fingers for aligning the heated blanks 26 in a predetermined position prior to entering the hot forming apparatus 30. The blanks 26 are preferably positioned as close together as possible to reduce waste material during the hot forming step. The blank feeder 28 of the exemplary embodiment is movable vertically along the second sides of the shelves 32 for conveying the heated blanks 26 from each of the shelves 32 to the hot forming apparatus 30. The third driven rollers 46 align with and are timed to move with the first driven rollers 42 of the shelves 32 at approximately the same rate. Alternatively, the blank feeder 28 could be removable, and another robot (not shown) could plug the blank feeder 28 into the furnace 24. The blank feeder 28 is preferably insulated from the surrounding environment, or includes a heater (not shown) so that the heated blanks 26 are at a desired temperature when they enter the hot forming apparatus 30. The system 22 can also include another robot (not shown) for lifting the heated blanks 26 off the blank feeder 28 and placing the heated blanks 26 in position relative to the cavities 56 of the hot forming apparatus 30. Alternatively, the system 22 could include another method, such as a mechanical transfer system, for conveying the heated blanks 26 from the furnace 24 to the hot forming apparatus 30.

The system 22 also typically includes transfer bars (not shown) for removing the shaped parts 20 from the hot forming apparatus 30 and depositing them on a conveyor 60. The conveyor 60 is disposed adjacent the hot forming apparatus 30 opposite the blank feeder 28 for conveying the shaped parts 20 away from the hot forming apparatus 30. Alternatively, the shaped parts 20 could be removed from the hot forming apparatus 30 through another automated or manual process.

The exemplary system 22 also comprises a system controller 62 including a computer, as shown in FIG. 1, for controlling the blank feeder 28, blank loader 48, and conveyor 60. For example, the system controller 62 can instruct the blank loader 48 to move vertically along the first side of the furnace 24 in order to feed unheated blanks 26 into open chambers 36 of the furnace 24 and can instruct the blank feeder 28 to move vertically along the second side of the furnace 24 to convey the heated blanks 26 away from particular chambers 36 once they reach a predetermined temperature. Additionally, the system controller 62 can instruct the blank loader 48 to automatically bypass any chambers 36 in the furnace 24 that are malfunctioning or have already been removed. This allows the system 22 to continue operating even if one or more heaters 34 in the furnace 24 is malfunctioning, which is in contrast to other known hot stamping systems that must be completely shut down if the heater is malfunctioning. As discussed above, the robot 50, furnace 24, and hot forming apparatus 30 are controlled independently by their own controllers, but the system controller 62 can share signals between the controllers of the robot 50, furnace 24, and hot forming apparatus 30. The system controller 62 also verifies that each component of the system 22 is operating correctly in order to maximize the efficiency.

The invention also provides a method for hot stamping a plurality of steel parts 20 providing reduced overhead costs per part 20 and requiring less floor space, compared to other hot forming methods. The method first includes feeding the blanks 26 onto the shelves 32 of the furnace 24, typically by moving the unheated blanks 26 along the second driven rollers 44 of the blank loader 48, through the first doors 38 of the chambers 36, and onto the shelves 32. The second driven rollers 44 are aligned with the first driven rollers 42 of one of the shelves 32, and the first and second driven rollers 42, 44 are timed to move together at approximately the same rate. The method also includes moving the blank loader 48 vertically relative to the first sides of the shelves 32 and feeding the unheated blanks 26 onto each of the shelves 32. Alternatively, the method could include plugging the blank loader 48 into the furnace 24.

The method next includes heating the blanks 26 while the blanks 26 are disposed on the shelves 32, and conveying the blanks 26 along the first driven rollers 42 through the furnace 24. The metal blanks 26 remain in the furnace 24 for an amount of time capable of providing a desired microstructure. For example, the blanks 26 can be heated while continuously moving through the furnace 24, or while resting on the shelves 32 while the first driven rollers 42 remain stationary for a period of time. In another embodiment, the first driven rollers 42 oscillate forward and backward with the blanks 26. The oscillating first driven rollers 42 can prevent hot and cold spots along the blanks 26, prevent the blanks 26 from drooping, and can help maintain the integrity of any coating applied to the blanks 26.

If one of the heaters 34 malfunctions, the method includes removing the chamber 36 containing the malfunctioning heater 34, or removing the malfunctioning heater 34 and the adjacent shelf 32, while continuing to heat the blanks 26 disposed on the other shelves 32. The method also includes fixing the malfunctioning heater 34 while continuing to heat and convey the blanks 26 along the remaining shelves 32 of the furnace 24. Further, the method can include bypassing one of the shelves 32 of the furnace 24 when the heater 34 adjacent the shelf 32 is malfunctioning, or bypassing one of the chambers 36 when the heater 34 contained in the chamber 36 is malfunctioning. Thus, the method can continue manufacturing the shaped parts 20 even when one of the heaters 34 of the furnace 24 is down.

The method next includes conveying the heated blanks 26 from the shelves 32 of the furnace 24 to the hot forming apparatus 30. The conveying step includes moving the heated blanks 26 from the first driven rollers 42 of the furnace 24 to the third driven rollers 46 of the blank feeder 28. The third driven rollers 46 align with the first driven roller 42 and are timed to move together with the first driven rollers 42. In the exemplary embodiment, the method includes moving the blank feeder 28 vertically along the stack of shelves 32 and conveying the heated blanks 26 from each of the shelves 32 to the hot forming apparatus 30. In one embodiment, the method includes isolating the heated blanks 26 from the outside environment while conveying them from the furnace 24 to the hot forming apparatus 30, or heating the blanks 26 while conveying them from the furnace 24 to the hot forming apparatus 30.

Once the heated blanks 26 are disposed between the dies 52, 54 of the hot forming apparatus 30, the method includes stamping the heated blanks 26 between the dies 52, 54 to form a plurality of the shaped parts 20. The stamping step can include simultaneously shaping one of the blanks 26 into a plurality of shaped parts 20 using the plurality of cavities 56 in the hot forming apparatus 30. The method then includes cooling each of the shaped parts 20 while the shaped parts 20 are disposed in the cavities 56 of the hot forming apparatus 30. In one embodiment, the cooling step includes cooling at least two of the shaped metal parts 20 in the cavities 56 at different rates to achieve different microstructures in the shaped metal parts 20.

Obviously, many modifications and variations of the present invention are possible in light of the above teachings and may be practiced otherwise than as specifically described while within the scope of the appended claims.

What is claimed is:

1. A system for hot forming a plurality of parts, comprising:

a furnace including a plurality of shelves stacked vertically relative to one another, each of said shelves including a plurality of first driven rollers for conveying a plurality of blanks through said furnace;

said furnace including a plurality of heaters for heating said blanks, each of said heaters being disposed adjacent one of said shelves, and each of said heaters and said adjacent shelf being removable from said furnace;

a hot forming apparatus for shaping said heated blanks; and a blank feeder for conveying said heated blanks from said shelves of said furnace to said hot forming apparatus.

2. The system of claim 1, wherein said furnace includes a plurality of chambers stacked vertically relative to one another and each containing one said shelves and one of said heaters.

3. The system of claim 2, wherein each of said chambers is individually removable from said furnace.

4. The system of claim 2, wherein each of said chambers includes a first door at a first side of said chamber and a second door at a second side of said chamber opposite said first side, and said chambers are sealed from one another and from the surrounding environment.

5. The system of claim 1, wherein said hot forming apparatus includes a plurality of cavities for shaping at least one of said blanks into a plurality of shaped parts.

6. The system of claim 1, wherein said blank feeder includes a plurality of driven rollers for conveying said heated blanks from said shelves of said furnace to said hot forming apparatus.

7. The system of claim 1, wherein said blank feeder is movable vertically relative to said stack of shelves for conveying said heated blanks from each of said shelves to said hot forming apparatus.

8. The system of claim 1, wherein said blank feeder is insulated from the surrounding environment and extends continuously from said furnace to said hot forming apparatus.

9. The system of claim 1, further comprising a blank loader including a plurality of driven rollers and being movable vertically along said shelves for feeding said blanks to each of said shelves.

10. The system of claim 1, wherein said blanks are formed of steel material, each of said shelves extends horizontally from a first side to a second side opposite said first side and presents an area for supporting a plurality of said blanks;

said furnace includes a plurality of chambers stacked vertically relative to one another, each of said chambers containing one of said shelves and one of said heaters;

each of said chambers includes a first door at said first side and a second door at said second side and is sealed from the other chambers and from the outside environment;

each of said chambers are individually fixable to other chambers and individually removable from said stack of chambers;

said hot forming apparatus includes an upper die and a lower die facing one another and presenting a plurality of cavities therebetween for simultaneously shaping at least one of said heated blanks into a plurality of individual parts;

said hot forming apparatus includes a plurality of cooling ports extending along said cavities for conveying a cooling fluid therethrough;

said blank feeder extending continuously from said furnace to said hot forming apparatus and being movable vertically relative to said stack of chambers of said furnace for conveying said heated blanks from each of said chambers to said hot forming apparatus;

said blank feeder being insulated from the surrounding environment and including a heater; and further comprising:

a blank loader including a plurality of driven rollers and being movable vertically along said chambers for feeding said blanks to each of said chambers;

a robot for disposing said blanks on said blank loader;

a conveyor disposed adjacent said hot forming apparatus opposite said blank feeder for conveying said shaped individual parts away from said hot forming apparatus; and a system controller for controlling said blank loader, said blank feeder, and said conveyor, and sharing signals between controllers of said robot, said furnace, and said hot forming apparatus.

11. A method for hot forming a plurality of parts, comprising the steps of:

conveying a plurality of blanks along a plurality of shelves of a furnace;

heating the plurality of blanks using a heater disposed adjacent each shelf;

removing the heater and the adjacent shelf from the furnace when the heater is malfunctioning while continuing to heat the blanks on the other shelves;

conveying the heated blanks from the furnace to a hot forming apparatus; and shaping the heated blanks in the hot forming apparatus.

12. The method of claim 11, wherein the furnace includes a plurality of chambers stacked vertically relative to one another, and each of the chambers contains one of the shelves and one of the heaters.

13. The method of claim 12 including removing one of the chambers from the stack when the heater contained therein is malfunctioning; and continuing to heat the blanks in the other chambers.

14. The method of claim 13 including fixing the malfunctioning heater while continuing to heat the blanks in the other chambers.

15. The method of claim 12 including heating at least one of the chambers to a temperature different from other chambers.

16. The method of claim 12 including feeding the blanks to the shelves of the chambers by disposing the blanks on a blank loader including a plurality of driven rollers, moving the blank loader vertically relative to the shelves, and bypassing one of the chambers when the heater contained therein is malfunctioning.

17. The method of claim 11 wherein the step of conveying the heated blanks from the furnace to the hot forming apparatus includes insulating the blanks from the outside environment and conveying the heated blanks directly from the furnace to the hot forming apparatus.

18. The method of claim 11 wherein the shaping step includes shaping one of the blanks into a plurality of shaped parts.

19. The method of claim 18 including cooling the shaped parts at different rates in the hot forming apparatus.

20. The method of claim 11, wherein the blanks are formed of a steel material, the furnace includes a plurality of chambers stacked vertically relative to one another, each of the chambers contains one the shelves and one of the heaters, and each of the shelves includes a plurality of driven rollers;

the step of conveying the heated blanks along the shelves includes moving the blanks along the plurality of driven rollers;

the step of conveying the heated blanks from the furnace to the hot forming apparatus includes conveying the heated blanks along a plurality of driven rollers of a blank feeder;

the step of conveying the heated blanks from the furnace to the hot forming apparatus further includes moving the blank feeder vertically along the stack of chambers and conveying the heated blanks from each of the chambers to the hot forming apparatus;

the shaping step includes simultaneously shaping a plurality of the blanks, and shaping one of the blanks in a plurality of cavities to form a plurality of shaped parts; and further comprising:

feeding the plurality of blanks formed of a steel material into the chambers by disposing the blanks on a blank loader including a plurality of driven rollers, aligning the driven rollers of the blank loader with the driven rollers of one of the shelves, and moving the blank loader vertically along the stack of chambers;

the feeding step including bypassing one of the chambers of the furnace when the heater contained therein is malfunctioning;

removing one of the chambers from the stack of chambers when the heater contained therein is malfunctioning while continuing to heat the blanks disposed in the other chambers;

fixing the malfunctioning heater while continuing to heat the blanks in the other chambers;

heating one chamber of the furnace to a temperature different from other chambers;

insulating the blanks while conveying the heated blanks continuously from the furnace to the hot forming apparatus;

cooling each of the shaped parts while the shaped parts are disposed in the cavities of the hot forming apparatus; and the cooling step including cooling at least two of the shaped parts in the cavities at a different rates.

* * * * *